US007265311B1

(12) United States Patent
Schaltenbrand et al.

(10) Patent No.: US 7,265,311 B1
(45) Date of Patent: Sep. 4, 2007

(54) ARC CHAMBER BARRIER WITH INTERLOCKING TOP FOR CIRCUIT BREAKER

(75) Inventors: Brian John Schaltenbrand, Cranberry Township, PA (US); Robert William Mueller, Aliquippa, PA (US); Mark Anthony Janusek, Pittsburgh, PA (US); Keith Edward Thomas, Burgettstown, PA (US)

(73) Assignee: Caton Corporation, Cleveland, OH (US)

( * ) Notice: Subject to any disclaimer, the term of this patent is extended or adjusted under 35 U.S.C. 154(b) by 0 days.

(21) Appl. No.: 11/411,601

(22) Filed: Apr. 26, 2006

(51) Int. Cl.
*H01H 33/02* (2006.01)

(52) U.S. Cl. ..... 218/156; 200/244; 218/41

(58) Field of Classification Search ..... 218/14–21, 218/34–41, 147–149, 153–157; 200/244, 200/401; 335/15, 16, 147, 201, 202
See application file for complete search history.

(56) References Cited

U.S. PATENT DOCUMENTS 5,635,886 A * 6/1997 Pichard ..... 335/132
5,938,008 A 8/1999 Wehrli, III et al.
6,005,206 A 12/1999 Rakus et al.

FOREIGN PATENT DOCUMENTS

EP 1073084 A2 * 1/2001

* cited by examiner

*Primary Examiner*—Elvin Enad
(74) *Attorney, Agent, or Firm*—Martin J. Moran

(57) ABSTRACT

An arc chamber barrier for a circuit breaker is provided. The arc chamber barrier has a body with a first interlock component that is structured to engage a second interlock component disposed in the circuit breaker primary cover. The arc chamber barrier body is further structured to be disposed in an elongated contact chamber at the interface of an arc chamber portion and an operating mechanism portion. In this configuration, the arc chamber barrier first interlock component resists displacement of the arc chamber barrier body when a pair of separable contacts moves between the second, closed position and the first, open position.

20 Claims, 3 Drawing Sheets

ARC CHAMBER BARRIER WITH INTERLOCKING TOP FOR CIRCUIT BREAKER

BACKGROUND OF THE INVENTION

1. Field of the Invention

The present invention relates to a molded case circuit breaker and, more specifically to an arc chamber barrier of a molded case circuit breaker.

2. Background Information

Circuit breakers, including molded case circuit breakers, have at least one pair of separable contacts. A first contact is fixed within the molded case housing and the other contact, the "movable contact," is coupled to an operating mechanism. Both contacts are disposed on conductive "arms" that are in electrical communication with either the line or load coupled to the circuit breaker. The operating mechanism is structured to move the movable contact between a first, open position wherein the movable contact is spaced from the fixed contact, and a second, closed position wherein the fixed and movable contacts are in contact and electrical communication. The operating mechanism may be operated manually or by the circuit breaker's trip mechanism. When a circuit breaker has multiple poles, each pole has its own set of separable contacts. Each set of contacts is disposed within a separate contact chamber within the molded case housing.

The housing, typically, has a base portion, in which the majority of components are disposed, and a primary cover. Both the base portion and the primary cover include a plurality of internal walls which define the contact chamber(s). Each contact chamber has an arc chamber portion and an operating mechanism portion. The operating mechanism, or part thereof, coupled to each contact arm is disposed in the operating mechanism portion. The arc chamber portion encloses the separable contacts as well as an arc chamber and, possibly, a slot motor. An arc chamber is structured to dissipate an arc following separation of the contacts. That is, when the contacts are separated an arc may form, especially during an over-current event. The arc is dissipated in the arc chamber but the arc still creates gases and possibly a spray of molten debris. A slot motor is a ferro-magnetic device structured to increase the speed of contact separation. That is, the slot motor is a loop of ferro-magnetic material disposed about the movable contact arm. Electro-magnetic fields within the circuit breaker effect the slot motor which in turn creates a magnetic field that increases the speed of the movable contact arm during separation. The stronger the electrical current, the stronger the magnetic field. Thus, during an over-current event, the magnetic field is strong and the speed of separation is increased. This configuration causes certain problems.

One problem is the blowback of arc gases and molten debris into the operating mechanism portion of the contact chamber. The arc gases are typically vented through an exhaust; however, the arc gases, which may be corrosive, and the molten debris also impact on the operating mechanism components causing damage thereto. Further, movement of the movable contact must be arrested prior to the movable contact or the movable contact arm impacting upon the slot motor or the housing. This is especially true during an over-current event when the movable contact arm is moving at great speed. Both of these concerns have been addressed by introducing an arc chamber barrier.

The arc chamber barrier is a non-conductive body shaped as an inverted "U" which is disposed between the arc chamber portion and the operating mechanism portion. The arc chamber barrier is typically fitted into the base portion of the housing and does not extend into the area occupied by the cover. Further, the size of the arc chamber barrier is slightly smaller than the size of the contact chamber so that it may be easily installed. When installed, the arc chamber barrier, which has two tines and a bight, is disposed over the medial portion of the movable contact arm so that the movable contact arm travels in the space between the tines. The bight is structured to arrest the movement of the movable contact arm. That is, the movable contact arm impacts the bight and is stopped. The arc chamber barrier body substantially fills the contact chamber. As such, debris is substantially blocked from traveling into the operating mechanism portion of the contact chamber. Further, because the gap between the tines is relatively small, the arc gases will typically pass through the exhaust. While arc chamber barriers are an improvement, the barriers create other disadvantages.

For example, a typical arc chamber barrier is not attached to the base portion of the housing. This lack of attachment along with the smaller size of the arc chamber barrier allows the arc chamber barrier to be moved, typically upwardly, when impacted by the movable contact arm. When the arc chamber barrier is moved from its original position, the arc chamber barrier may move into the path of travel of the movable contact arm, e.g. the tines may pinch the movable contact arm. Further, if the arc chamber barrier is not in the proper position, an additional impact from the movable contact arm may cause the arc chamber barrier to break and allow the debris therefrom to interfere with the operating mechanism. Also, because the size of the prior art arc chamber barrier is slightly smaller than the size of the contact chamber, the prior art arc chamber barrier allows arc gases and debris to pass around the arc chamber barrier.

Further, the prior art arc chamber barriers were structured primarily as a debris shield and not structured to optimize the separation speed of the movable contact arm. That is, in addition to other factors, such as, but not limited to, the strength of the magnetic field created by the slot motor, the impact speed of the movable arm during separation is controlled by the configuration of the circuit breaker housing and the operating mechanism configuration. One additional factor related to the configuration of the circuit breaker housing is the pressure within the contact chamber during an arc. That is, when an arc occurs and gasses are created, the pressure within the contact chamber increases. It has been determined that the greater the pressure, the greater the separation speed of the movable contact arm. In a three pole circuit breaker, the contact chambers extend parallel to each other. While the two outer contact chambers have a relatively small volume, the middle chamber is larger as it must accommodate additional components of the operating mechanism, such as, but not limited to, the operating handle. As such, the contact chamber of the "mechanism pole" of the circuit breaker has a larger volume than the contact chambers of the two outer poles. Thus, because the arc gases have a larger volume to fill, the increase in pressure within the mechanism pole contact chamber is less than the increase in pressure of the other contact chambers.

There is, therefore, a need for an arc chamber barrier structured to resist displacement when the separable contacts move between a second, closed position and a first, open position.

There is a further need for an arc chamber barrier structured to interlock with the circuit breaker housing cover.

There is a further need for an arc chamber barrier structured to fill a greater volume of the contact chamber thereby increasing the pressure within the contact chamber during an arc event.

SUMMARY OF THE INVENTION

These needs, and others, are met by the present invention which provides an arc chamber barrier having a first interlock component disposed on the bight. The second interlock component is disposed on the circuit breaker housing cover. When assembled, the arc chamber barrier is rigidly coupled to the cover. Moreover, when the cover is attached to the housing assembly base portion, the cover biases the arc chamber barrier toward the base portion. As such, the arc chamber barrier fits snugly within the contact chamber and resists being moved or breaking, even when impacted by the movable contact arm. The arc chamber barrier also includes an extension extending over the length of its lateral sides. This extension engages the housing, both the base portion and the cover, and resists the passage of gases and debris. The arc chamber barrier further has a volume that is about 20% of the volume of the contact chamber. The volume of the arc chamber barrier decreases the empty volume of the contact chamber and thereby increases the pressure within the contact chamber during an arc event. The arc chamber barrier also has an increased area on the bight. The bight fits into the cover and reduces the quantity of debris that passes into the area housing the operating mechanism. Also the bight substantially seals the mechanism pole arc chamber, increasing the pressure that results from an arc event and thereby improving the interruption response of the circuit breaker. In addition, the bight is stronger and less likely to break due to an impact from the movable contact arm.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, directional terms, e.g., "above," "below," "upper," "lower," etc., are used for convenience relative to the Figures and are not intended to limit the claims.

Figure 1:
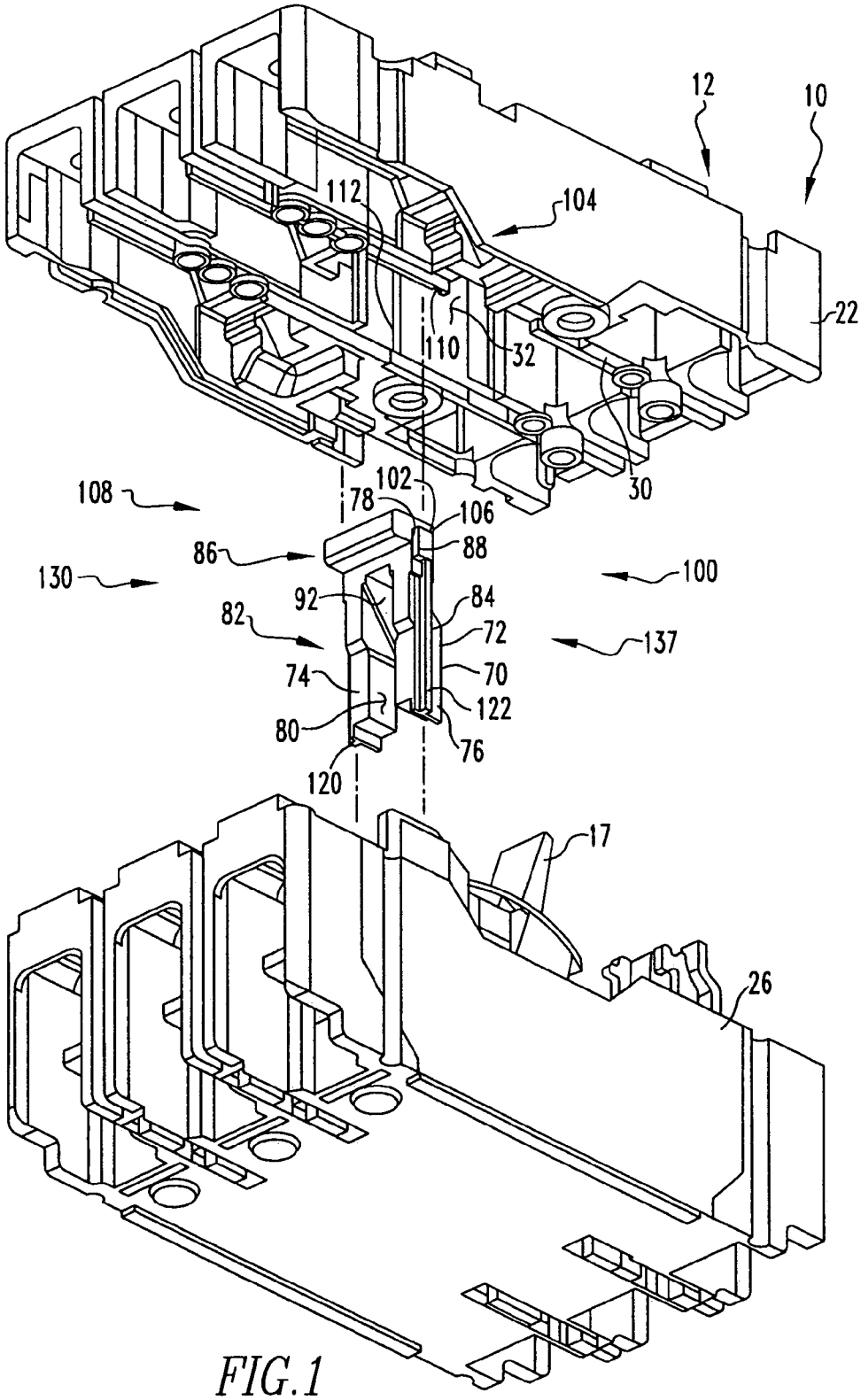
FIG. 1 is an exploded isometric view of a circuit breaker.
Figure 2:
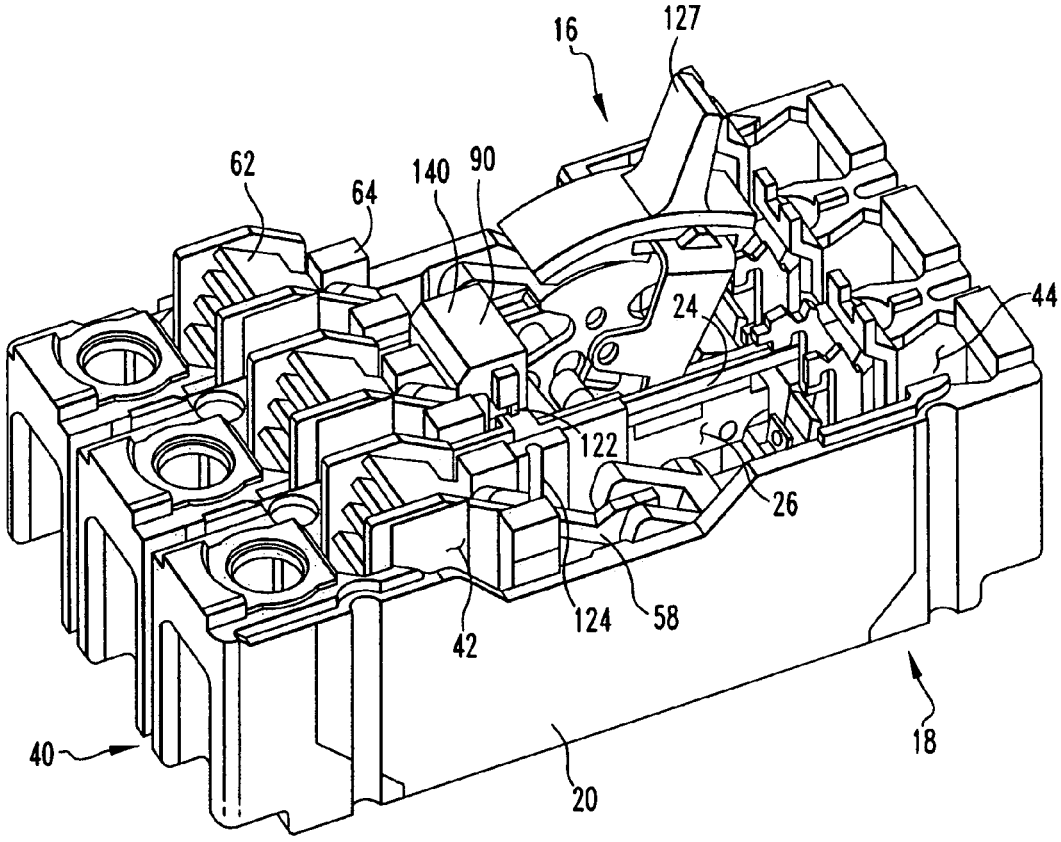
FIG. 2 is a top isometric view of a circuit breaker base portion.

As shown in FIGS. 1 and 2, a molded case circuit breaker 10 includes a housing assembly 12, at least one conductor assembly 14, an operating mechanism 16, and a trip device 18. As shown in the Figures, the circuit breaker 10 is a three pole circuit breaker 10 and, as such, the Figures show three of certain elements, such as, but not limited to, three contact chambers 40 (discussed below). However, it is understood that the present invention also is applicable to a circuit breaker having at least one set of separable contacts 52 (FIG. 3) as well as at least one of each associated component or elements.

The housing assembly 12 includes an elongated base portion 20 which is coupled to an elongated primary cover 22. The base portion 20 includes a plurality of internal walls 24 defining at least one elongated cavity 26. The primary cover 22 also includes a plurality of internal walls 30 which also defines at least one elongated cavity 32. As noted above, in a three pole circuit breaker 10 there are three sets of base portion cavities 26 and primary cover cavities 32. The base portion cavities 26 and primary cover cavities 32 extend generally parallel to each other and parallel to a longitudinal axis of the housing assembly 12. The base portion cavities 26 generally align with the primary cover cavities 32 so that when the primary cover 22 is coupled to the base portion 20, the base portion cavities 26 and the primary cover cavities 32 define at least one contact chamber 40, and in a three pole circuit breaker 10, three contact chambers 40.

Figure 3:
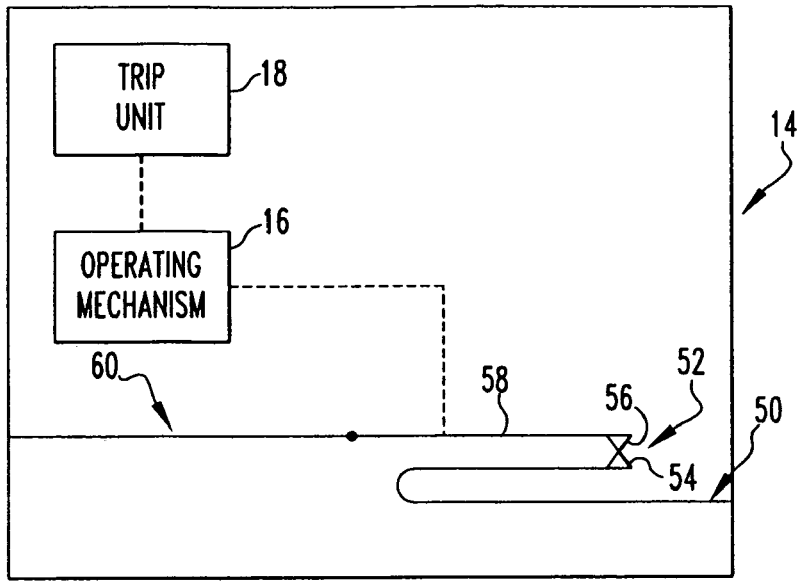
FIG. 3 is a schematic view of a circuit breaker.

At least one conductor assembly 14, an operating mechanism 16, and a trip device 18, shown schematically in FIG. 3, are disposed within the housing assembly 12. Each conductor assembly 14 extends through a contact chamber 40. Each conductor assembly 14 includes a line terminal 50, a pair of separable contacts 52 including a stationary contact 54 and a movable contact 56 disposed on a moving arm 58, and a load terminal 60. The operating mechanism 16 is coupled to each moving arm 58 and is structured to move the at least one pair of separable contacts 52 between a first, open position and a second, closed position. The operating mechanism 16 may be actuated by the trip device 18 or manually actuated by an operating mechanism handle 17 (FIG. 2) as is known in the art.

As shown in FIG. 2, each conductor assembly 14 may also include an arc chamber 62 and/or a slot motor 64 disposed adjacent to the pair of separable contacts 52. The arc chamber 62 is disposed adjacent to the path of travel of the moving arm 58 and is structured to extinguish an electrical arc should such an arc occur when the separable contacts 52 move from the second, closed position to the first, open position. The slot motor 64 is disposed about, or on either side of, the path of travel of the moving arm 58 and is structured to accelerate the moving arm 58 as the separable contacts 52 move from the second, closed position to the first, open position.

Each contact chamber 40 has an arc chamber portion 42 and an operating mechanism portion 44. The interface between the arc chamber portion 42 and the operating mechanism portion 44 is located immediately adjacent to the separable contacts 52. The arc chamber 62 and/or a slot motor 64 are disposed within the arc chamber portion 42. The operating mechanism 16 is disposed within the operating mechanism portion 44. An arc chamber barrier 70 is disposed at each interface between an arc chamber portion 42 and an operating mechanism portion 44.

Each arc chamber barrier 70 has a body 72 generally shaped as an inverted "U." That is, each body 72 has two tines 74, 76 and a bight 78. The bight 78 maintains the tines 74, 76 in a spaced relation. Stated another way, between the two tines 74, 76 is a gap 80. The tines 74, 76 each have an outer, lateral side 82, 84. The bight 78 has two opposing outer lateral sides 86, 88, an upper surface 90, and an inner surface 92. Each bight lateral side 86, 88 is contiguous with one of the tine outer lateral sides 82, 84. The bight inner surface 92 is, preferably, angled so that the bight inner surface 92 is parallel to the moving arm 58 when the moving arm 58 is in the first position. The bight upper surface 90 is structured to engage the primary cover 22. By engaging the primary cover 22, the arc chamber barrier 70 accomplishes two desired results. First, the primary cover 22 biases the arc chamber barrier 70 toward the base portion 20. Thus, the arc chamber barrier 70 is both trapped and snug within the associated contact chamber 40. When the arc chamber barrier 70 is not free to move, there is a reduced risk that the moving arm 58 will move the arc chamber barrier 70 from the intended position as the separable contacts 52 move from the second, closed position to the first, open position. Second, by engaging the primary cover 22, the arc chamber barrier 70 reduces the amount of arc gases that may pass over the arc chamber barrier 70 and into the operating mechanism portion 44.

Figure 4:
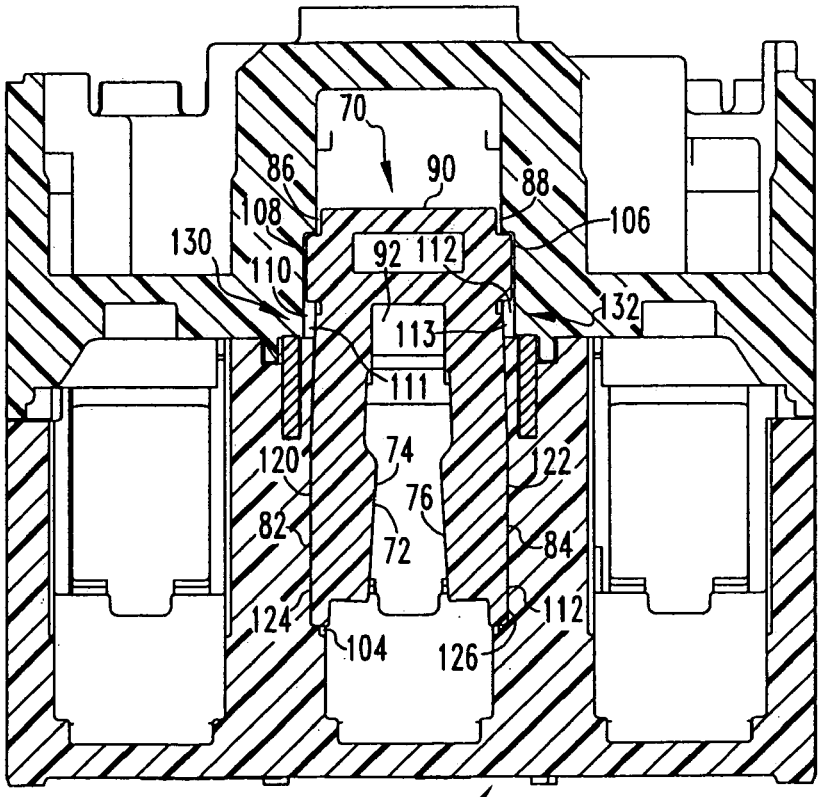
FIG. 4 is a cross-sectional view of an arc chamber barrier and interlock device.

As shown in FIG. 4, each arc chamber barrier 70 is further maintained in the intended position by an interlock device 100. The interlock device 100 includes a first component 102 disposed on the arc chamber barrier body 72 and a second component 104 disposed on the primary cover 22. The interlock device 100 components 102, 104 may be any type of corresponding components, such as, but not limited to, a ball and socket/detent, corresponding snap-fit components, or a pin and opening. However, in the preferred embodiment, the interlock device 100 is a tongue and groove structure. The arc chamber barrier body 72, and more specifically the bight lateral sides 86, 88 includes at least one, and preferably two, projections 106, 108. The primary cover 22 includes at least one, and preferably two, slots 110, 112 extending in a generally vertical direction and structured to engage the bight projections 106, 108. In this configuration, when the arc chamber barrier 70 is disposed within a contact chamber 40, the interlock device 100 substantially prevents the arc chamber barrier 70 from moving vertically and/or twisting relative to the contact chamber 40. As such, the arc chamber barrier 70 is less likely to be damaged as the separable contacts 52 move from the second, closed position to the first, open position.

Additionally, each tine outer lateral side 82, 84 may also have an elongated, longitudinal ridge 120, 122 extending therefrom. The ridges 120, 122 are, preferably, contiguous with the bight projections 106, 108 and share a common longitudinal edge. The base portion 20 may have elongated vertical channels 124, 126 structured to engage the ridges 120, 122. In this configuration, the bight projections 106, 108 and the ridges 120, 122 form a lateral extension 130, 132. Each lateral extension 130, 132 extends over substantially all of one lateral side of the arc chamber barrier body 72. When the arc chamber barrier 70 is disposed within a contact chamber 40, the lateral extensions 130, 132 extend over substantially the vertical length of the base portion walls 24 and the primary cover walls 30, thereby blocking arc gas and debris from passing around the outer lateral sides of the arc chamber barrier 70. As shown, the bight projections 106, 108 have a greater thickness and/or width than the tine outer lateral side ridges 120, 122. As such, the primary cover slots 110, 112 are slightly deeper and/or wider than the base portion vertical channels 124, 126. When assembled, this configuration creates pockets 111, 113 between the bight projections 106, 108 and the base portion 20. One side of each pocket 111, 113 is closed by the common longitudinal edge extending across the associated bight projections 106, 108 and tine ridges 120, 122. That is, the primary cover 22 is also structured to engage the portion of the tine ridges 120, 122 that extends above the base portion 20 and into the primary cover 22.

The bight 78 may also include a cantilever portion 140. The cantilever portion 140 both increases the area of the bight 78 and the volume of the arc chamber barrier 70. By increasing the area of the arc chamber barrier 70 which the moving arm 58 impacts, the load caused by that impact is distributed and the chance that the moving arm 58 will damage the arc chamber barrier 70 as the separable contacts 52 move from the second, closed position to the first, open position is reduced. By increasing the volume of the arc chamber barrier 70 the empty volume of the contact chamber 40 is decreased and, therefore, the pressure created by the arc gas within the contact chamber 40 during an arc event is increased. Preferably, the bight inner surface 92 has an area between about 0.250 $in^2$ and 0.300 $in^2$, and, more preferably, about 0.292 $in^2$. The volume of the arc chamber barrier body 72 is, preferably, between about 15% and 25% of the arc chamber portion 42 volume, and more preferably about 20% of the arc chamber portion 42 volume.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An arc chamber barrier for a circuit breaker, said circuit breaker having a housing assembly with a base portion and a primary cover, said base portion and said primary cover structured to be coupled together and to define at least one elongated contact chamber, said at least one contact chamber having an arc chamber portion and an operating mechanism portion, said primary cover having a second interlock component, at least one pair of separable contacts disposed in said at least one contact chamber, said at least one pair of separable contacts including a stationary contact and a movable contact disposed on a moving arm, an operating mechanism disposed in said circuit breaker housing assembly and coupled to said at least one pair of separable contacts and structured to move said at least one pair of separable contacts between a first, open position and a second, closed position, said arc chamber barrier comprising:

an arc chamber barrier body having a first interlock component, said arc chamber barrier first interlock component structured to engage said primary cover second interlock component;

said arc chamber barrier body structured to be disposed in said at least one elongated contact chamber at the interface of said arc chamber portion and said operating mechanism portion; and whereby said arc chamber barrier first interlock component resists displacement of said arc chamber barrier body when said at least one pair of separable contacts moves between said second, closed position and said first, open position.

2. The arc chamber barrier of claim 1 wherein:

said first interlock component is at least one projection extending outwardly from said body; and said second interlock component is at least one slot structured to engage said at least one projection.

3. The arc chamber barrier of claim 2 wherein:

said arc chamber barrier body has an inverted "U" shape with two tines and a bight, said bight having two lateral, outer sides;

said at least one projection extending outwardly from said body includes two projections, one projection extending from each said lateral, outer side of said bight; and said at least one slot structured to engage said at least one projection includes two slots, each slot structured to engage one of said two projections.

4. The arc chamber barrier of claim 3 wherein:

said base portion includes two elongated channels, said channels disposed on opposing sides of said contact chamber, each said channel further aligned with one of said cover slots;

said arc chamber barrier body includes two elongated ridges, one of said two ridges disposed on the outer side of one of said two tines, each said ridge extending to, and being integral with, one of said two projections; and wherein, when said primary cover is coupled to said base portion and said arc chamber barrier body is disposed in said contact chamber, each said ridge and associated projection create a lateral extension extending over substantially all of one lateral side of said arc chamber barrier body.

5. The arc chamber barrier of claim 3 wherein:

said bight has an upper surface;

said bight upper surface structured to engage said primary cover; and said primary cover structured to bias said arc chamber barrier body toward said housing assembly base portion when said primary cover is coupled to said base portion.

6. The arc chamber barrier of claim 5 wherein:

said arc chamber barrier bight has an inner surface, said bight inner surface structured to be a stop for said movable contact; and said bight inner surface having an area between about 0.250 $in^2$ and 0.300 $in^2$.

7. The arc chamber barrier of claim 6 wherein said bight inner surface has an area of about 0.292 $in^2$.

8. The arc chamber barrier of claim 7 wherein:

said arc chamber portion has a volume; and said arc chamber barrier body has a volume which is between about 10% and 25% of said arc chamber portion volume.

9. The arc chamber barrier of claim 8 wherein said arc chamber barrier body has a volume which is about 20% of said arc chamber portion volume.

10. The arc chamber barrier of claim 2 wherein:

said arc chamber barrier body has an inverted "U" shape with two tines and a bight, said bight having an upper surface;

said bight upper surface structured to engage said primary cover; and said primary cover structured to bias said arc chamber barrier body toward said housing assembly base portion when said primary cover is coupled to said base portion.

11. A circuit breaker comprising:

a circuit breaker housing assembly having a base portion and a primary cover, said base portion and said primary cover structured to be coupled together and to define at least one elongated contact chamber, said at least one contact chamber having an arc chamber portion and an operating mechanism portion;

at least one pair of separable contacts disposed in said at least one contact chamber, said at least one pair of separable contacts including a stationary contact and a movable contact disposed on a moving arm;

an operating mechanism disposed in said circuit breaker housing assembly and coupled to said at least one pair of separable contacts and structured to move said at least one pair of separable contacts between a first, open position and a second, closed position;

an arc chamber barrier disposed in said at least one elongated contact chamber at the interface of said arc chamber portion and operating mechanism portion, said arc chamber barrier having a body;

said arc chamber barrier body having a first interlock component;

said primary cover having a second interlock component;

wherein, said arc chamber barrier first interlock component engages said primary cover second interlock component; and whereby said arc chamber barrier resists displacement when said at least one pair of separable contacts moves between said second, closed position and said first, open position.

12. The circuit breaker of claim 11 wherein:

said first interlock component is at least one projection extending outwardly from said body; and said second interlock component is at least one slot structured to engage said at least one projection.

13. The circuit breaker of claim 12 wherein:

said arc chamber barrier body has an inverted "U" shape with two tines and a bight, said bight having two lateral, outer sides;

said at least one projection extending outwardly from said body includes two projections, one projection extending from each said lateral, outer side of said bight; and said at least one slot structured to engage said at least one projection includes two slots, each slot structured to engage one of said two projections.

14. The circuit breaker of claim 13 wherein:

said base portion includes two elongated channels, said channels disposed on opposing sides of said contact chamber, each said channel further aligned with one of said cover slots;

said arc chamber barrier body includes two elongated ridges, one of said two ridges disposed on the outer side of one of said two tines, each said ridge extending to, and being integral with, one of said two projections; and wherein, when said primary cover is coupled to said base portion and said arc chamber barrier body is disposed in said contact chamber, each said ridge and associated projection create a lateral extension extending over substantially all of one lateral side of said arc chamber barrier body.

15. The circuit breaker of claim 13 wherein:

said bight has an upper surface;

said bight upper surface structured to engage said primary cover; and said primary cover structured to bias said arc chamber barrier body toward said housing assembly base portion when said primary cover is coupled to said base portion.

16. The circuit breaker of claim 15 wherein:

said arc chamber barrier bight has an inner surface, said bight inner surface structured to be a stop for said movable contact; and said bight inner surface having an area between about 0.250 $in^2$ and 0.300 $in^2$.

17. The circuit breaker of claim 16 wherein said bight inner surface has an area of about 0.292 $in^2$.

18. The circuit breaker of claim 17 wherein:

said arc chamber portion has a volume; and said arc chamber barrier body has a volume which is between about 10% and 25% of said arc chamber portion volume.

19. The circuit breaker of claim 18 wherein said arc chamber barrier body has a volume which is about 20% of said arc chamber portion volume.

20. The circuit breaker of claim 12 wherein:

said arc chamber barrier body has an inverted "U" shape with two tines and a bight, said bight having an upper surface;

said bight upper surface structured to engage said primary cover; and said primary cover structured to bias said arc chamber barrier body toward said housing assembly base portion when said primary cover is coupled to said base portion.

* * * * *